United States Patent [19]

Sato

[11] Patent Number: 4,484,100

[45] Date of Patent: Nov. 20, 1984

[54] CATHODE-RAY TUBE FOR PROJECTOR HAVING HEAT CONDUCTION AND RADIATING MEANS

[75] Inventor: Takeo Sato, Fukaya, Japan

[73] Assignee: Tokyo Shibaura Denki Kabushiki Kaisha, Kawasaki, Japan

[21] Appl. No.: 348,076

[22] Filed: Feb. 11, 1982

[30] Foreign Application Priority Data

Feb. 12, 1981 [JP] Japan ..... 56-18047

[51] Int. Cl.[3] ..... H01J 7/24; H01J 29/86

[52] U.S. Cl. ..... 313/44; 313/46; 313/477 R

[58] Field of Search ..... 313/477 R, 44, 46, 462; 220/2.3 A

[56] References Cited

U.S. PATENT DOCUMENTS 2,832,911 4/1958 Velzer ..... 313/429

3,681,637 8/1972 Simpson ..... 313/44

FOREIGN PATENT DOCUMENTS 1315125 4/1973 United Kingdom ..... 313/362

OTHER PUBLICATIONS

McGraw-Hill *Dictionary of Scientific and Technical Terms*, 2nd Edition, pp. 731 and 1180.

*Primary Examiner*—Palmer Demeo
*Assistant Examiner*—Sandra L. O'Shea
*Attorney, Agent, or Firm*—Finnegan, Henderson, Farabow, Garrett & Dunner

[57] ABSTRACT

A cathode-ray tube for a projector, wherein a mesh-like or striped heat conduction member is disposed on an outer surface of a faceplate corresponding to an effective area of a phosphor screen, and the heat conduction member is conductively in contact with a heat radiator which is secured on the outer side of the faceplate.

5 Claims, 4 Drawing Figures

CATHODE-RAY TUBE FOR PROJECTOR HAVING HEAT CONDUCTION AND RADIATING MEANS

BACKGROUND OF THE INVENTION

The present invention relates to a cathode-ray tube for a projector, the heat dissipation characteristic of which is improved.

In the cathode-ray tube for a projector, a phosphor screen formed on the inner surface of a faceplate is scanned with an electron beam from an electron gun. An image of an effective surface is thus obtained. The image of the effective surface is focused on a projection screen by an optical system arranged outside or inside the tube. The cathode-ray tube for a video projector must be activated at a final anode potential, that is, a potential of +25 kV to +30 kV on the phosphor screen. The phosphor screen of the cathode-ray tube for a video projector must be scanned with an electron beam in which the current density is a multiple of ten time the density of the electron beam used for a cathode-ray tube for television. 90% of the input power of 0.05 to 1.0 W/cm$^2$ will vanish as heat loss. The heat loss causes the temperature of the phosphor to rise in the effective area which is scanned with the electron beam and in the temperature of the outer surface of the faceplate corresponding to the effective area. Therefore, the following problems are presented.

(1) Luminous efficiency is degraded owing to the rise of temperature of the phosphor.

(2) The faceplate may be cracked by a stress which is caused by a difference between the temperature rise on the outer surface corresponding to the effective area and the temperature rise on the peripheral outer surface which surrounds the outer surface corresponding to the effective area.

In order to solve the first problem, a cooling mechanism on the inner surface of the faceplate may be adopted. However, such a cooling mechanism is not proposed in practice. In fact, a cooling mechanism which cools the phosphor indirectly from the outer surface of the faceplate is currently used. Further, in order to solve the second problem, it is very effective to reduce the temperature difference between the outer surface corresponding to the effective area and the peripheral outer surface by conducting heat on the outer surface of the faceplate corresponding to the effective area to the peripheral outer surface and the peripheral part of the faceplate. For this purpose, conventionally, various structures have been proposed. However, these cooling devices are large in size, resulting in low relative luminance. Thus, the satisfactory cathode-ray tube for a projector cannot be obtained.

SUMMARY OF THE INVENTION

It is an object of the present invention to provide a cathode-ray tube for a projector which is relatively simple in construction and low in cost and which eliminates or reduces the above problems.

In order to achieve the above and other objects of the present invention, there is provided a cathode-ray tube for a projector characterized in that a mesh-like or striped heat conduction member is disposed on the outer surface of the faceplate corresponding to the effective area of the phosphor screen, and the heat conduction member is conductively in contact with a heat radiator which is secured on the outer side of the effective area of the faceplate.

BRIEF DESCRIPTION OF THE DRAWINGS

FIGS. 1 and 2 are views showing a cathode-ray tube for a projector according to one embodiment of the present invention in which FIG. 1 is a sectional view thereof and FIG. 2 is a plan view of a heat radiating assembly thereof; and FIGS. 3 and 4 are graphs for comparing the characteristics of a conventional cathode-ray tube for a projector and a cathode-ray tube for a projector of one embodiment of the present invention, in which FIG. 3 is a graph for explaining the relation between the running period and the temperature rise at the central outer surface of a faceplate, and FIG. 4 is a graph for explaining the relation between a predetermined temperature-measuring position on the outer surface of the faceplate and the temperature rise on the outer surface thereof.

DETAILED DESCRIPTION OF THE PREFERRED EMBODIMENT

Figure 1:
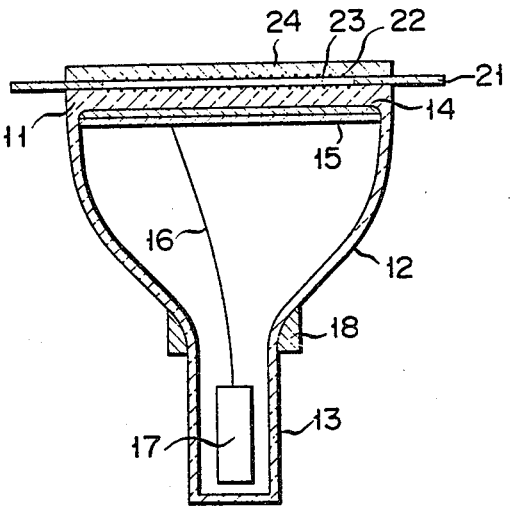
Figure 2:
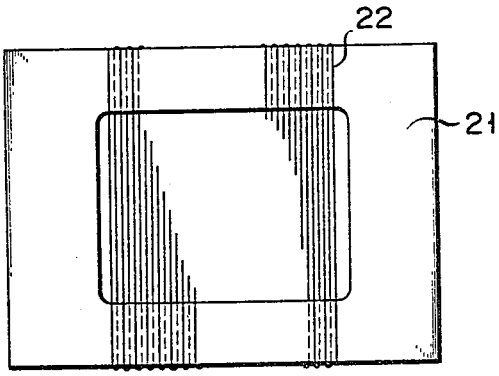

A cathode-ray tube for a projector according to one embodiment of the present invention will be described in detail with reference to FIGS. 1 and 2.

A phosphor screen 14 and a metal back layer 15 are formed on an inner surface of a faceplate 11 of an envelope comprising the faceplate 11, a funnel 12 and a neck 13. An electron gun 17 which emits an electron beam 16 for scanning an effective surface of the phosphor screen 14 is disposed in the neck 13. A deflection yoke 18 is mounted on an outer wall portion extending from the funnel 12 to the neck 13. The above structure is substantially the same as that in the conventional cathode-ray tube. Further, in the present invention, a number of thin wires 22 made of a good heat conduction material such as copper are meshed or arranged in a stripe pattern. The thin wires 22 are arranged in contact with the outer surface of the faceplate 11 corresponding to the effective area of the phosphor screen 14. Further, the ends of the thin wires 22 are conductively in contact with a frame-like heat plate 21 extending outward from the edge portion of the faceplate 11. The thin wires 22 are sealed in a transparent sealing member layer 23 of a thin film. Further, a transparent plate 24 for mechanically reinforcing and preventing damage of the transparent sealing member layer 23 is formed.

After the heat radiating plate 21 is formed, a copper wire of 0.1 to 0.2 mm in diameter is wound around the plate 21 at a pitch of 1 to 3 mm. Alternatively, a heat conductive member may be printed on a portion of the transparent plate 24 corresponding to the faceplate 11. In this case, the heat radiation plate 21 preferably extends from the periphery of the transparent plate 24 in consideration of heat radiation. The connection between the thin wires 22 and the heat radiating plate 21 shape may be preferably established by adhesion under pressure, soldering or welding. Further, it is effective to increase heat absorption and radiation by subjecting the heat radiating plate 21 and the thin wires 22 to the blackening treatment. A transparent synthetic resin, especially, an addition reaction type transparent silicone is preferable as the transparent sealing member layer 23.

According to a method for manufacturing a cathode-ray tube for a projector of the present invention, a heat radiating assembly comprising the heat dissipating plate 21 and the thin wires 22 is placed on the outer surface of the faceplate 11. Transparent silicone which is hardened by the addition reaction is poured. Further, the transparent plate 24 is placed on poured transparent silicone. The heat radiating assembly is sandwiched between the transparent plate 24 and the outer surface of the faceplate 11 and adhered under pressure.

Various characteristics of a conventional cathode-ray tube for a projector and a cathode-ray tube of one embodiment of the present invention will be described with reference to FIGS. 3 and 4.

Figure 3:
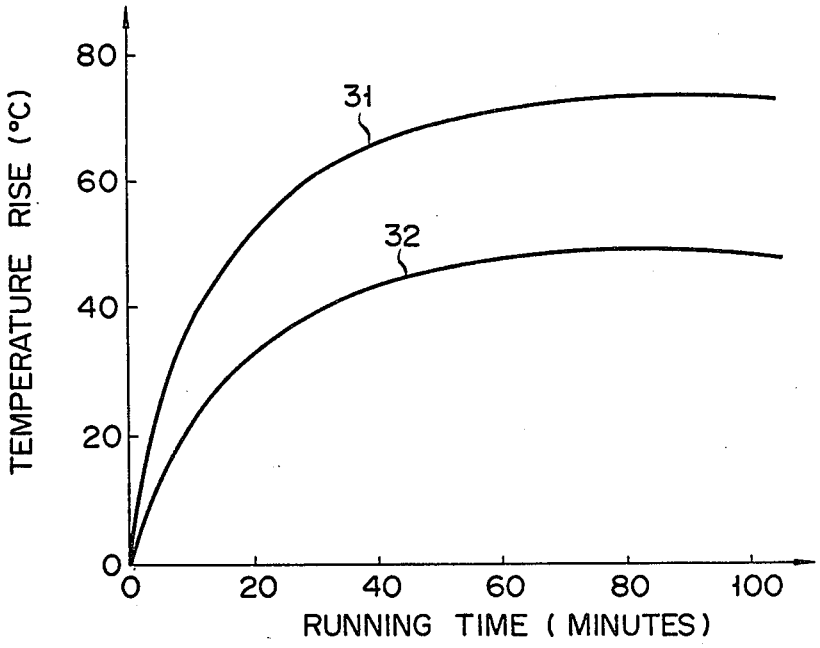
Figure 4:
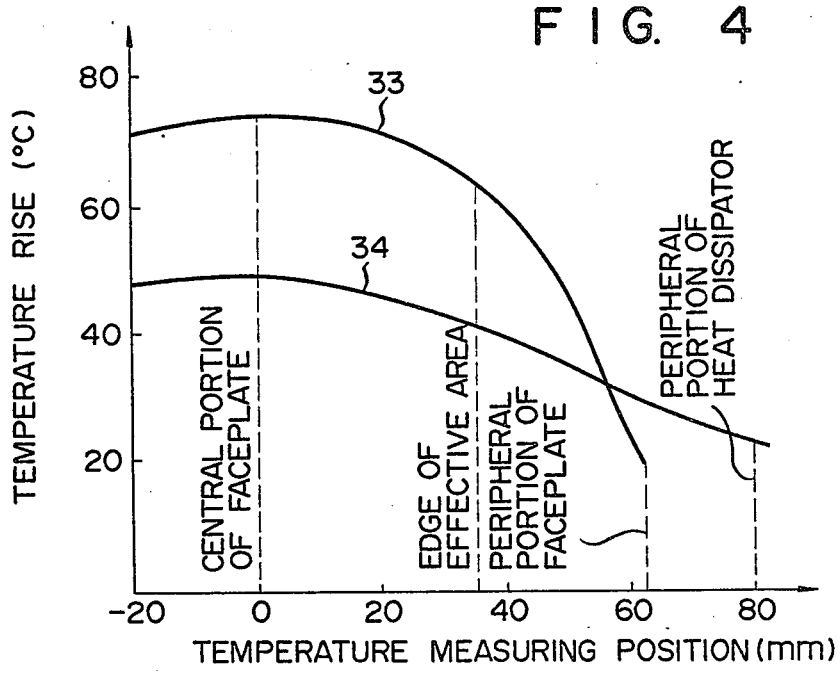

FIG. 3 shows a curve 31 indicating the relation between the temperature rise at the central outer surface of the faceplate corresponding to the effective area of the phosphor screen when a coventional cathode-ray tube which has a reactangular faceplate of 10 mm thickness is activated at an input power per unit area on the phosphor screen of 0.18 W/cm$^2$. This temperature rise is given by a difference between the measured temperature and room temperature. In this condition, the temperature rise at the central outer surface of the faceplate reaches 75° to 77° C.

On the other hand, according to the present invention, a non-coated copper wire 22 of 0.2 mm in diameter is wound around the heat radiating plate 21 of the frame-like shape which is made of an aluminum plate of 0.5 mm thickness, 180 mm length and 145 mm width and which has a rectangular opening of 120 mm length and 75 mm width at the center of the aluminum plate. The heat radiating plate 21 is wrapped by the copper wire at a pitch of about 2.5 mm. This heat radiating plate is placed on the rectangular faceplate of 10 mm thickness of the cathode-ray tube for a projector so as to align the opening with the outer surface corresponding to the effective area. Compositions A and B of the addition reaction type transparent silicone YE5822 manufactured by Toshiba Silicone KK are mixed in a ratio of 10:1. The mixture is filled in the opening. The transparent plate 24 of glass of 2 mm thickness is placed on the mixture. The mixture is then cured under proper pressure at a temperature of about 50° C. for 30 minutes to 1 hour. When the cathode-ray tube thus prepared is used under substantially the same conditions as in the conventional one, the temperature rise at the central portion of the faceplate 11 is indicated by a curve 32. The temperature rise saturates at 50° C.

The temperature rise at the central portion of the faceplate according to the present invention is 60% the temperature rise of the conventional faceplate. Further, the cooling effect of the faceplate according to the present invention is improved by about 34%.

The above comparison is performed when the thin copper wires 22 are not blackened. Further, the above embodiment of the present invention does not provide a tight contact between the heat radiating plate 21 and the copper wires 22. When these procedures are completely performed, the effects shown in FIG. 3 are further improved.

When the effects indicated by the curves 31 and 32 of FIG. 3 are applied to a case wherein an input power per unit area on the phosphor screen is 0.08 W/cm$^2$, the temperature rise is reduced by about 15° to 17° C. under natural convection on the outer surface of the faceplate. For example, when a phosphor screen made of a phosphor P43 ($Gd_2O_2S$: Tb) is used, luminance is increased by 13% as compared with the conventional sample. However, in consideration of the size of an opening which may be determined by the diameter of the copper wire and the pitch of the turns, and transmission loss of the transparent sealing member layer composed of transparent silicone and of the transparent plate, the total luminous efficacy is improved by 5%.

Therefore, in order to minimize the decrease in luminous efficacy due to the temperature rise of the phosphor, the size of the opening must be further enlarged and heat conductivity of the thin wires 22 must be increased.

The distribution of heat on the outer surface of the faceplate will be described with reference to FIG. 4.

In the same conditions as described above, the conventional cathode-ray tube for a projector and the cathode-ray tube of the present invention are activated. Temperatures at the central portion of the faceplate, at the portion corresponding to the edge of the outer surface corresponding to the effective area, and at the peripheral portion of the faceplate have been measured. Further, a temperature of the heat dissipating plate of the present invention has been also measured. The results are shown by a curve 33 for the conventional cathode-ray tube for a projector and by a curve 34 for the cathode-ray tube for a projector of the embodiment of the present invention.

The temperate of the outer surface of the faceplate corresponding to the central portion of the phosphor screen in the conventional cathode-ray tube for a projector is measured to be at a temperature of about 76° C. The temperature at the peripheral portion of the faceplate is about 20° C., resulting in a temperature difference of 56° C. On the other hand, according to the cathode-ray tube for a projector of the present invention, the temperature of the outer surface of the faceplate corresponding to the central portion of the phosphor screen is measured to be at about 50° C. The temperature at the peripheral portion of the heat radiating plate is about 23° C. Thus, the temperature difference is only about 27° C. Stress acting on the peripheral portion of the faceplate is thus reduced to about $\frac{1}{2}$ to $\frac{1}{3}$, facilitating the prevention of cracking of the faceplate.

In the above embodiment, the frame-like heat radiating plate and the metal wires having a a striped pattern are used. However, the present invention is not limited to this combination. A heat conduction member of a mesh-like pattern (including lattice and net-like patterns) may be used. Further, the mesh-like or striped heat conduction member may be printed on the transparent plate or on the faceplate. It is apparent that the transparent plate and the transparent sealing member layer may be eliminated. However, in this case, it is desired that the decrease in the luminous efficacy of the effective area be minimized.

According to the present invention, the temperature rise of the outer surface of the faceplate corresponding to the effective area is minimized. The heat radiating body is preferably in tight contact with the peripheral portion of the faceplate and adhered so as to reduce loss in heat conduction. Heat conducted from the central portion of the faceplate through the heat conduction member is used for raising the temperature at the periphery of the faceplate so as to reduce a temperature difference, thereby to reduce the stress acting on the peripheral portion of the faceplate. Thus, the cathode-ray tube of high luminance and high reliability is achieved according to the present invention.

Further, in the conventional cathode-ray tube for a projector, the outer surface of the faceplate is electrically charged, thus resulting in deposition of dust or the like. However, since the heat conduction member is made of an electrical conduction material, the heat conduction member may be grounded to the GND terminal of the power source of the cathode-ray tube for a projector. Thus, the electrostatic attraction on the outer surface of the faceplate or the transparent plate becomes substantially zero, thus eliminating the deposition of dust or the like thereon.

In summary, the cathode-ray tube for a projector according to the present invention is of high luminance and high reliability. Further, various expensive additional elements which are conventionally used for improving the luminance and image quality which may be degraded by contamination of the outer surface of the faceplate can be eliminated, thus facilitating the great industrial applicability.

What is claimed is:

1. A cathode-ray tube for a projector comprising:

a tube envelope including a faceplate having an inner surface and an outer surface;

a phosphor screen provided on said inner surface of said faceplate, said phosphor screen having an effective area to be scanned by an electron beam;

a mesh-like or striped heat conduction member disposed on said outer surface of said faceplate corresponding to said effective area of said phosphor screen; and a heat radiator secured on an outer side of said faceplate, said heat radiator being conductively in contact with said heat conduction member.

2. A cathode-ray tube for a projector according to claim 1, wherein said heat conduction member comprises thin copper wires having a diameter ranging between 0.1–0.2 mm.

3. A cathode-ray tube for a projector according to claim 1, wherein said heat conduction member is embedded in a transparent sealing member layer.

4. A cathode-ray tube for a projector according to claim 3, wherein a transparent protecting plate is further secured on said transparent sealing member layer.

5. A cathode-ray tube for a projector according to claim 4, wherein said heat radiator extends from a peripheral portion of said transparent protecting plate.

* * * * *